US006548809B2

(12) United States Patent
Bouyer et al.

(10) Patent No.: US 6,548,809 B2
(45) Date of Patent: Apr. 15, 2003

(54) ELECTROMAGNETIC DEVICE FOR PRODUCTION OF COLD NEUTRAL ATOMS

(75) Inventors: Philippe Bouyer, Bures-sur-Yvette (FR); Alain Aspect, Gif-sur-Yvette (FR); Michel Lecrivain, Ivry sur Seyne (FR); Bruno Desruelle, Paris (FR); Vincent Boyer, Paris (FR)

(73) Assignee: Etat Francais Represente par Letdelegue General pour l'Armement, Armees (FR)

( * ) Notice: Subject to any disclaimer, the term of this patent is extended or adjusted under 35 U.S.C. 154(b) by 257 days.

(21) Appl. No.: 09/796,698

(22) Filed: Mar. 2, 2001

(65) Prior Publication Data

US 2001/0042824 A1 Nov. 22, 2001

(30) Foreign Application Priority Data

Mar. 2, 2000 (FR) ..... 00 02704

(51) Int. Cl.[7] ..... H05H 3/01
(52) U.S. Cl. ..... 250/251
(58) Field of Search ..... 250/251

(56) References Cited

U.S. PATENT DOCUMENTS 6,476,383 B1 * 11/2002 Esslinger et al. ..... 250/251

OTHER PUBLICATIONS

B. Desruelle et al.: "Trapping Cold Neutral Atoms With An Iron–Core ELectromagnet", European Physical Journal D: Atoms, Molecules, Clusters and Optical Physics, EDP Sciences, Les Ulis., FR, 1998 pp. 255–258.

J. J. Tollet et al.: "Permanent Magnet Trap For Cold Atoms", Physical Review, A. General Physics, American Institute of Physics, New York, US, vol. 51, No. 1, Jan. 1995, pp. R22–R25.

T. Esslinger et al.: "Bose–Einstein condensation in a quadrople–Ioffe–configuration trap", Physical Review A (Atomic, Molecular, and Optical Physics), Oct. 1998, APS through AIP, USA, vol. 58, No. 4, pp. R2664–R2667.

* cited by examiner

*Primary Examiner*—John R. Lee
*Assistant Examiner*—Nikita Wells
(74) *Attorney, Agent, or Firm*—Oliff & Berridge, PLC

(57) ABSTRACT

An electromagnetic device for producing cold neutral atoms having a ferromagnetic structure with four poles disposed in the same plane XOY excited by main coils (the quadrupole) supplying the main excitation, and two additional poles (the dipole) oriented along an axis Z and perpendicular to the plane of said four poles, the poles being magnetically coupled by one or more yokes.

10 Claims, 5 Drawing Sheets

ELECTROMAGNETIC DEVICE FOR PRODUCTION OF COLD NEUTRAL ATOMS

BACKGROUND OF THE INVENTION

1. Field of Invention

The present invention relates to the field of cold neutral atom production by magnetic trapping.

2. Description of Related Art

The general principle of magnetic trapping of atoms is known. The article "Permanent Magnet Trap for Cold Atoms" which appeared in *Phys. Rev.* A 51, R22 (1995) describes for example a device having permanent magnets able to produce a very high field. The trap is charged from a slowed jet. A six-beam molasses in the heart of the trap cools down the trapped gas to a temperature of 200 microkelvins. To reach the high densities required for a high rate of elastic collisions, a very steep magnetic potential is required. The curves generated by the prior art devices are approximately 100 Gauss per $cm^2$.

However, such devices do not enable the condensate to be extracted outside the magnetic potential by cutting off the field, nor do they allow field curvatures to be modified. It is also possible to add coils to one or more poles to compensate for remanent fields.

Such a device is described in the article "Trapping Cold Neutral Atoms with an Iron-Core Electromagnet" in *Eur. Phys. J.* D 1, 255–258.

This document discloses the use of a ferromagnetic-core electromagnet to generate the trapping magnetic field. Such devices are not entirely satisfactory because Foucault currents limit the rise time and magnetic field cutoff time. To remedy these drawbacks, devices including electromagnets with improved confining power are desired.

SUMMARY OF THE INVENTION

The invention relates to a device with additional poles comprised of an external structure and an internal structure, said poles being excited separately by two coils traversed by opposing currents. In particular, the invention relates to an electromagnetic device for producing cold neutral atoms having a ferromagnetic structure with four poles disposed in the same plane XOY excited by main coils (the quadrupole) supplying the main excitation, and two additional poles (the dipole) oriented along an axis Z and perpendicular to the plane of said four poles, the poles being magnetically coupled by one or more yokes. "Yoke" is understood to be a part made of ferromagnetic material that circulates the flux.

This device is a compensated-bias Ioffe-Pritchard trap for trapping cold atoms (Bose-Einstein condensates) and/or creating a coherent cold-atom source, to achieve high compression ratios with low power consumption. It allows continuous or pulsed operation with turn-off times of 100 microseconds. It also enables the magnetic fields produced by the various coils to be adjusted by adjusting the current flowing through the excitation coils.

Advantageously, the additional poles are formed by an essentially cylindrical core, one end of which is provided with a coaxial annular cavity whose interior accommodates the interior excitation coil.

According to a preferred embodiment, at least some of the poles have a sleeve provided with a tubular channel for circulation of a heat-regulating fluid. Said sleeve is preferably surrounded by the compensating coil.

According to one variant, the yokes are formed by two annular elements with radius $R_{int}$ and $R_{ext}$ with $R_{ext}=R_{int}+E$ where E is the thickness of the yoke, the two elements being nestable and positioned in two perpendicular planes.

Advantageously, the yokes are formed by a first annular element extending over 180°, extended at each end by second annular elements extending over 90°, in a plane perpendicular to the plane of the first element, each of said second annular elements being coupled with an annular element extending over 180° in a plane perpendicular to the other annular elements.

According to one preferred embodiment, the yokes and poles are made of a ferromagnetic material limiting Foucault currents, particularly a laminated ferromagnetic material or sintered materials. According to one example, the yoke has annular lamination perpendicular to the lamination of the poles. Preferably, the ends of at least some of the poles are beveled.

BRIEF DESCRIPTION OF THE DRAWINGS

The invention will be better understood by reading the description hereinbelow that refers to a nonlimiting embodiment and to the attached figures wherein.

DETAILED DESCRIPTION OF PREFERRED EMBODIMENTS

Figure 1:
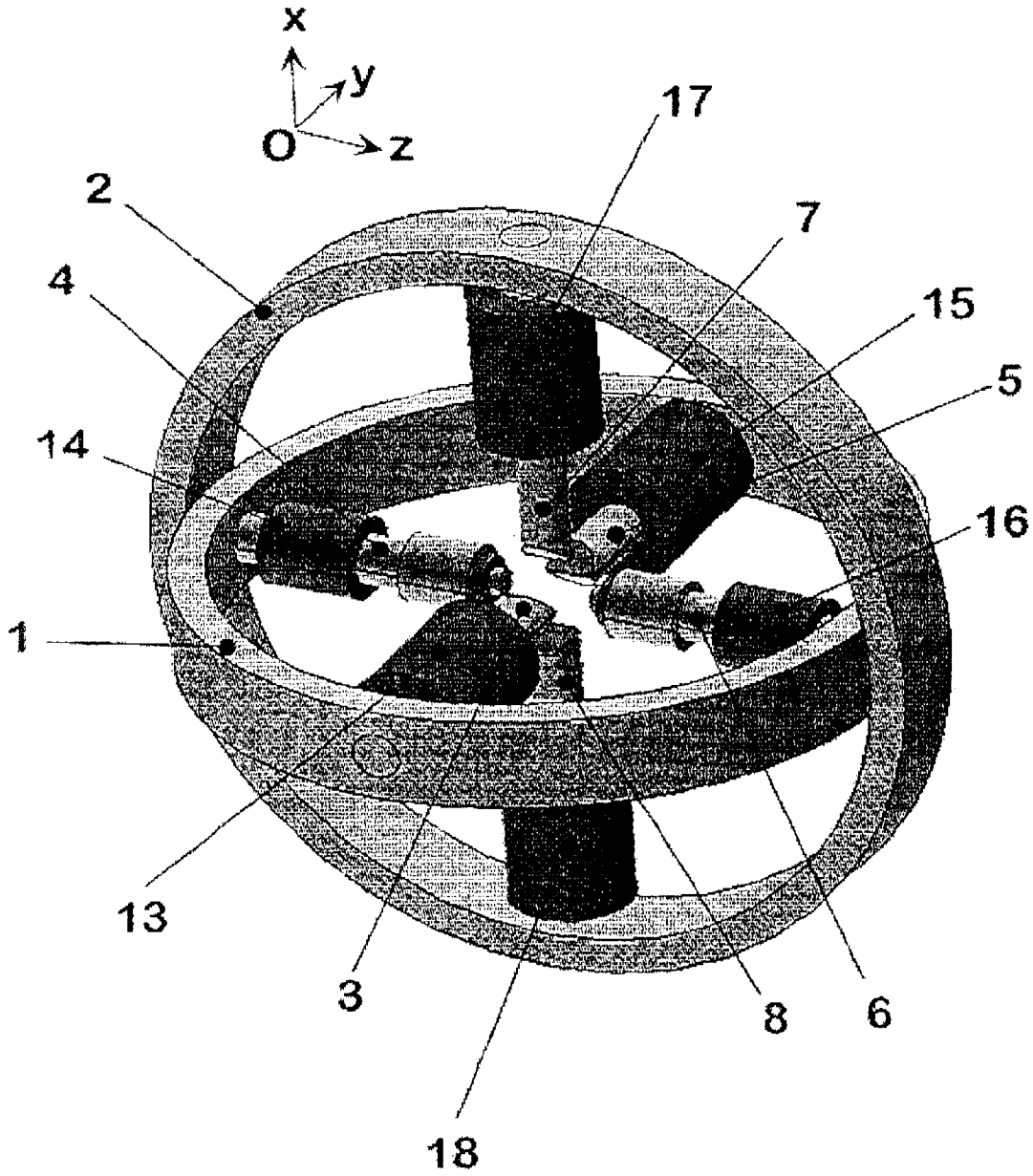
FIG. 1 is a schematic view of a first exemplary embodiment of a device according to the invention.

FIG. 1 is a view of a first embodiment.

The device consists of two doughnut-shaped yoke elements (1, 2) and six radial polar elements (3 to 8).

Yokes (1,2) are formed by winding a strip of ferromagnetic material. The yokes have different radii to enable the internal yoke to be nested in the external yoke, with the two yokes (1,2) having perpendicular median planes. The first yoke (1) is placed in the plane YOZ. The second yoke (2) is placed in the plane XOZ. The four poles (3, 5, 7, 8) are placed in plane XOY. They are formed by a ferromagnetic core made of a laminated material, surrounded by a coil (13, 17, 15, 18) with a copper tube supplying the main excitation, and by an additional coil (not shown) providing a remanent-field-compensating field.

Poles (3 and 5) and (7, 8) in plane XOY are placed opposite each other and are excited by opposing currents to create a quadrupolar field in plane XOY with amplitude $B=G(xe_x+ye_y)$ where G designates the magnetic field gradient.

The second two poles (4, 6) are oriented along axis Z and consist of a ferromagnetic core made of a laminated material surrounded by an external coil (14 and 16). These two poles (4, 6) also have an internal coil (27, 28) traversed by a current in the direction opposing the current flowing through the external coil. The internal structure enables a dipolar field with axis of symmetry Z to be created:

$$B_z = B_o + C\left(z^2 - \frac{x^2 + y^2}{2}\right)$$

where C designates the curvature of the dipolar field (axis 3).

The external structure creates a field with the same shape that enables $B_0$ to be compensated, while retaining a high value for C. A total field is obtained whose modulus corresponds to an Ioffe-Pritchard-type potential:

$$|B| = \left(B_0^{int} - B_0^{ext} + \left(\frac{G^2}{2(B_0^{int} - B_0^{ext})} - \frac{(C^{int} - C^{ext})}{2}\right)(x^2 + y^2) + (C^{int}C^{ext})z^2\right.$$

Figure 2:
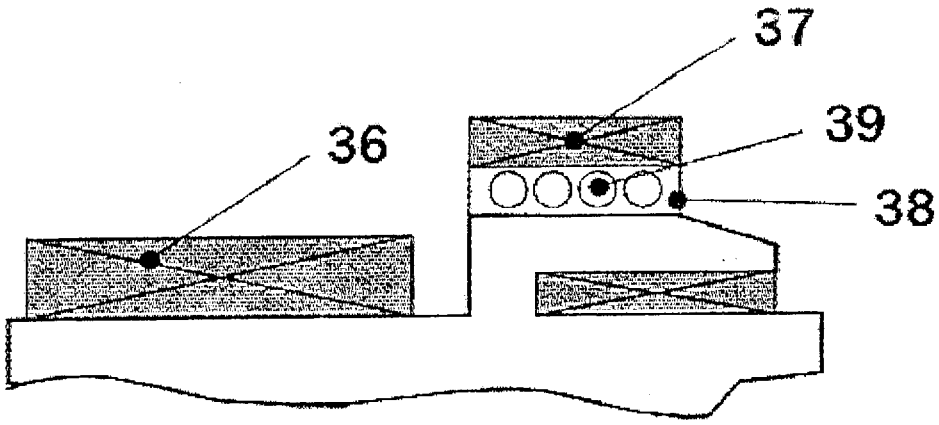
FIG. 2 is a median-section view of an additional pole on an enlarged scale.
Figure 2:
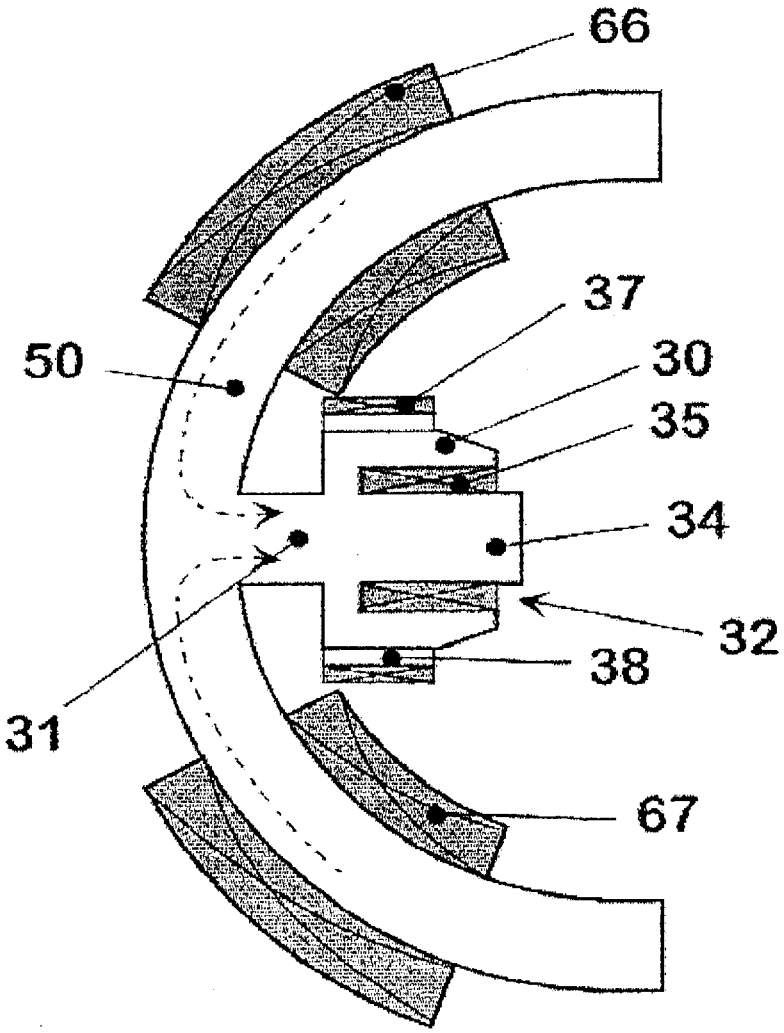

The device has, in addition to quadrupole (3, 5, 7, 8), a dipole formed by the two poles (4, 6) disposed along axis z of which FIG. 2 is a detailed view in lengthwise section. The function of this dipole is to compensate the constant field in the center of the trap to produce substantial confinement, while allowing pulse rates greater than 0.01 Hz, on the order of 1 Hz, to be obtained.

The poles of the dipole have a laminated core (31) with a frustroconical end (30).

The core has an axial cavity (32) with an annular shape which accommodates a electric coil (35) surrounding a cylindrical core (31).

Main core (31) is surrounded by a first main coil (14, 16) (FIG. 1) and a remanent field compensating coil (37).

Main coil (36) and internal coil (35) are fed in series and push-pull feed in pulsed mode. The coils of one of the poles and the coils of the opposite matching pole are themselves connected for series feed in the same direction and not push-pull.

The secondary remanent field compensating coil (37) is mounted on an annular heat-stabilizing structure (38) surrounding the center part of pole (31). This annular structure (38) has an annular channel (39) for circulation of a thermostatically controlled fluid.

The set of coils is supplied by pulsed current, power approximately 150 W, to produce a gradient of approximately 2400 Gauss per centimeter, with a factor of merit F of approximately 80,000.

The inter-pole spacing is approximately 4 centimeters. The pole diameter is approximately 20 millimeters. A cylindrical cell with a diameter of 25 millimeters is located in this space.

Figure 3:
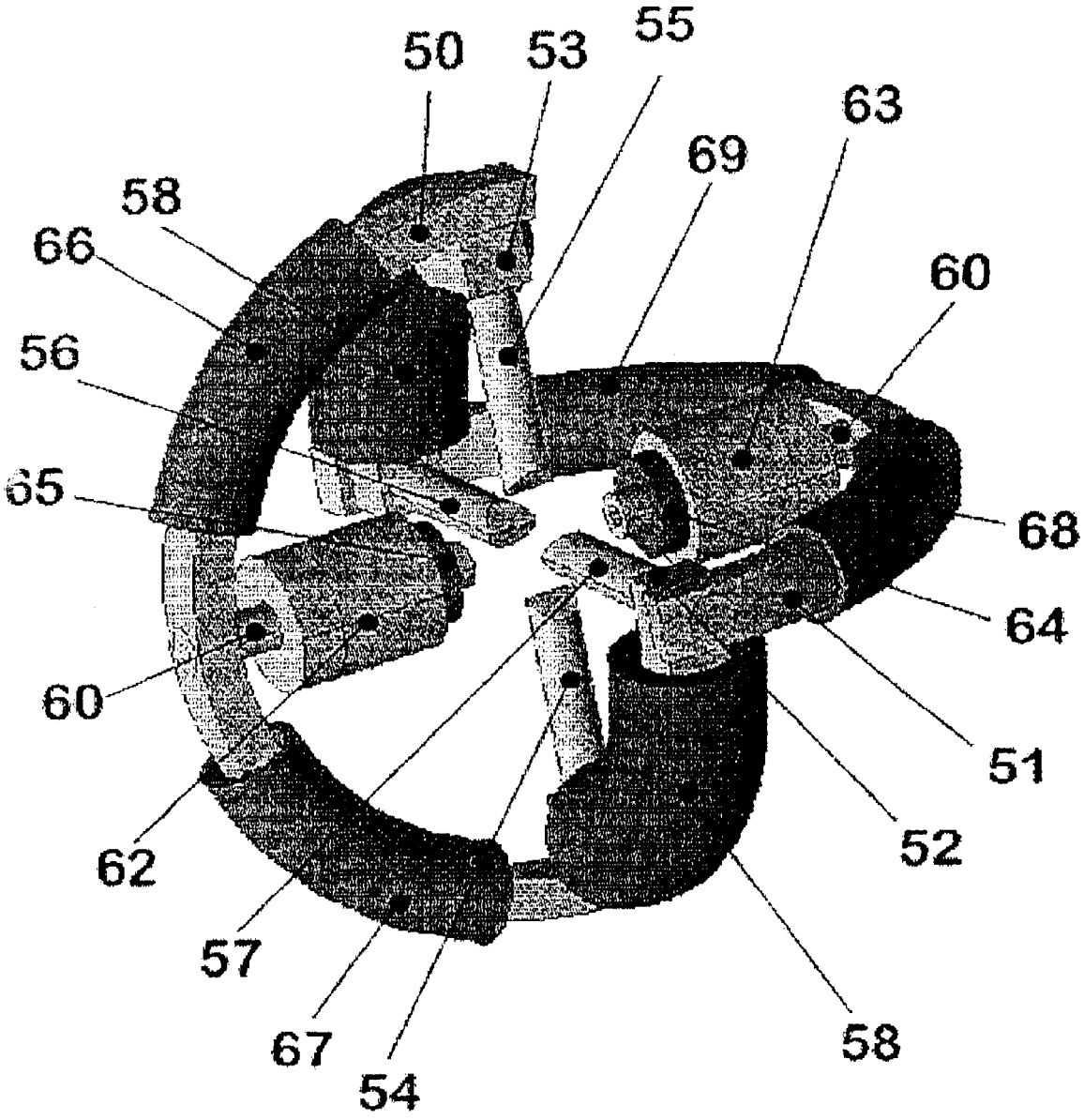
FIG. 3 is an alternative exemplary embodiment of a device according to the invention.

FIG. 3 shows one exemplary embodiment of a cold-atom trapping structure.

The ferromagnetic structure is composed of two semicircular rings (50, 51) disposed in perpendicular planes. These two arcs (50, 51) are formed of quarter-circle arcs (52, 53) whose ends are joined to the ends of semicircular arcs (50, 51), respectively. These quarter-circle arcs (52, 53) are in a third plane XOY perpendicular to the intersection of the two aforementioned planes.

The structure with four main poles (54 to 57) quadrupoles XOY excited by coils (58, 59), supplied by currents in the same direction, with coils (58, 59) surrounding arcs (52, 53) in a quarter-circle manner.

Each of semicircular arcs (50, 51) is coupled with an additional pole (60, 61) extending radially. These poles (60, 61) are surrounded by a heat-stabilizing structure. The main excitation is supplied by coils (66, 67) and (68, 69) distributed over semicircular arc (50, 51) on either side of secondary pole (60, 61). Contrary currents flow through them.

The devices a enable a very steep and adjustable magnetic potential to be generated.

Figure 4:
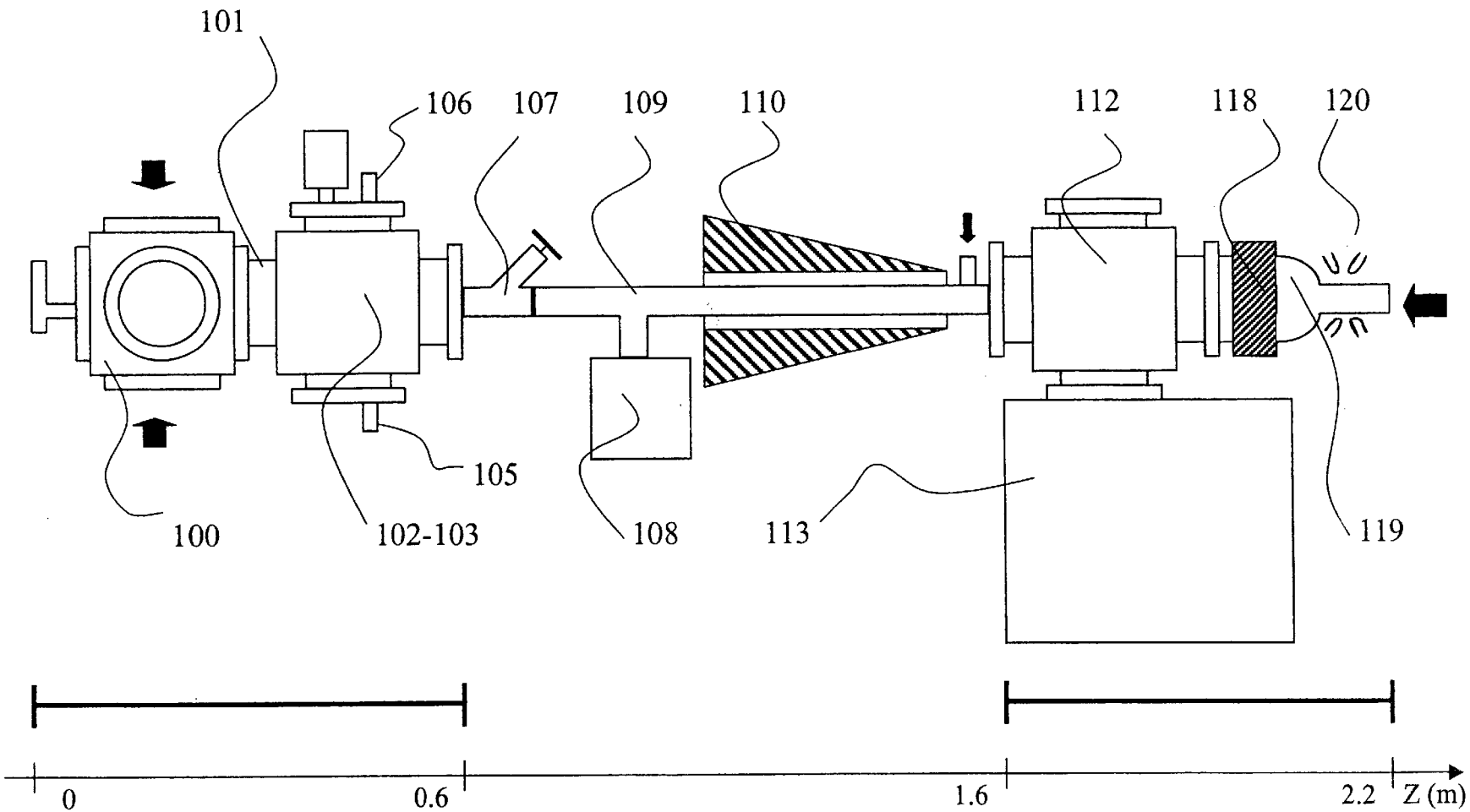
FIG. 4 is a schematic view of an apparatus implementing a device according to the invention.

FIG. 4 shows one example of equipment employing a device according to one or another of the embodiments of the invention.

The equipment has a recirculating furnace (100) heated to approximately 140° C. to produce a stream of $^{67}$Rb atoms. Optical molasses 2D produced by a transverse laser beam collimates the stream and orients it in the axis of a tube (101). This tube (101) leads to a primary enclosure (102) connected to a vacuum pump (103). The pressure $P_1$ prevailing in enclosure (102) is approximately $10^{-9}$ millibar. The pump is a turbo pump with a very high compression ratio (greater than $19^9$ for nitrogen). Enclosure (102) is provided with a cold cathode gage (105) to measure pressure.

The molasses is obtained by laser diodes, power 50 to 100 mW, and a 3.5 mW, 780 nm master laser with a beam width of 1 MHz.

Since some of the laser beams counterpropagate detuned to the red of the atomic transition, this produces a radiation pressure force on the illuminated atom.

A cold cylinder is positioned in the enclosure to stick the uncollimated atoms together. It is formed of a metal block provided with a hole 10 millimeters in diameter. It allows only the atoms in the stream emitted on the axis to pass. This cylinder is cooled by a flexiplunger (106) which circulates ethylene glycol at a temperature of −55° C.

A valve (107) allows the secondary enclosure to be isolated. An ion pump (108) creates the intermediate vacuum through a slower tube (109). This slower (109) thermally insulates the furnace (100) from secondary enclosure (112). Secondary enclosure (112) is comprised of a 1×2 cm glass cell connected to an ion pump (113) and a titanium sublimator. The walls are periodically heated to compensate for rubidium vapor formation.

Electromagnetic trap (120) according to the invention is placed at the outlet of a slower (118) with an electric coil (119).

Figure 5:
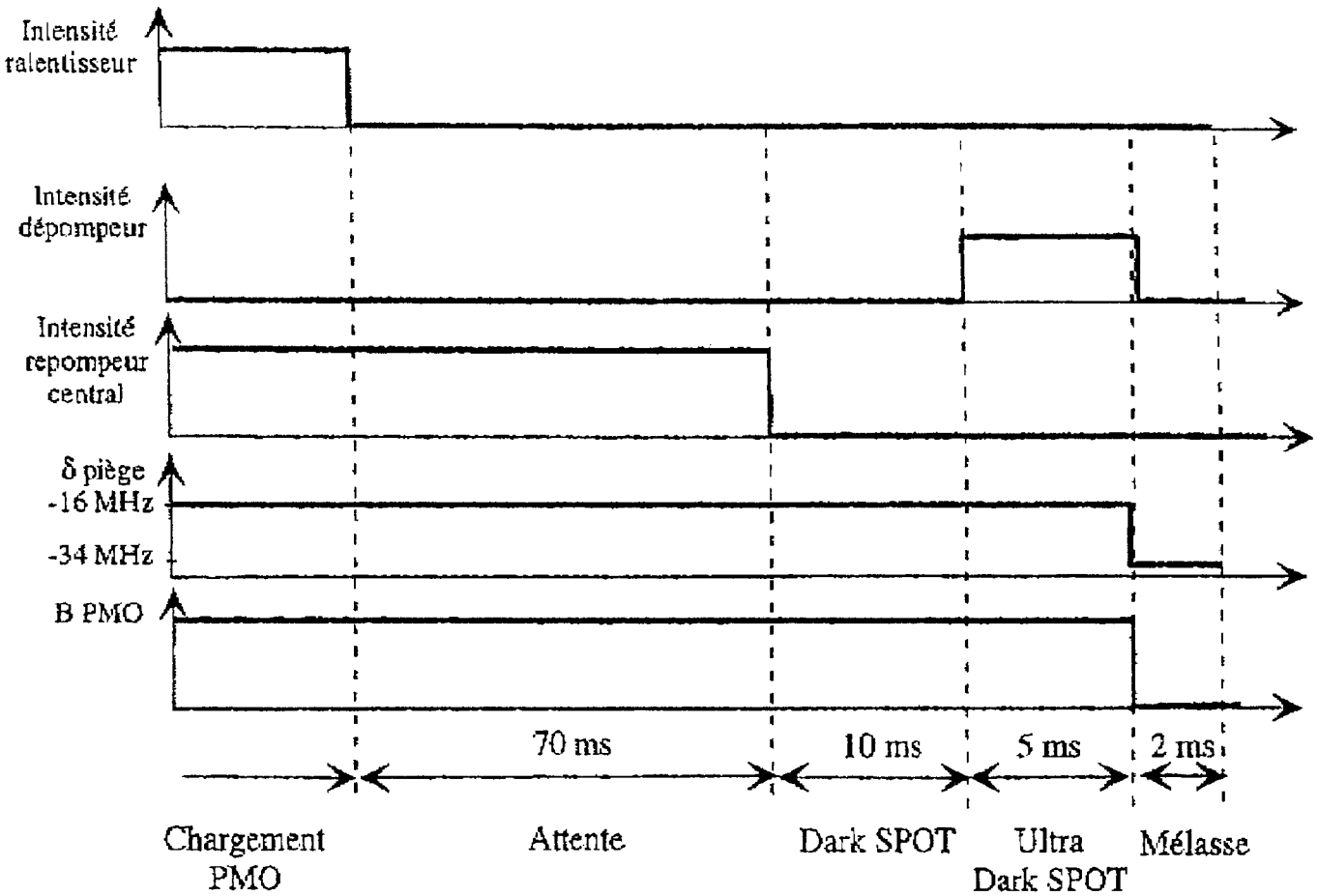
FIG. 5 shows the operating cycle of an exemplary device according to this invention.

FIG. 5 shows the time sequence of the apparatus.

The various stages of the operating cycle are synchronized. The spherical quadrupolar field produced by the main poles is interrupted and the untuning of the trapping beams is increased prior to the depump beam being turned off. During this sequence, the repump side beams remain on.

Remanent field compensation to demagnetize the ferromagnetic structure allows for effective cooling.

The applications of such devices are, in particular, atomic clocks and on-board navigation systems.

What is claimed is:

1. An electromagnetic device for producing cold neutral atoms comprising:

a ferromagnetic structure with four poles disposed in a same plane XOY excited by main coils supplying a main excitation; and two additional poles oriented along an axis Z and perpendicular to the plane of said four poles, the poles being magnetically coupled by one or more yokes, wherein the additional poles are comprised of an external structure and an internal structure excited separately by two coils traversed by opposing currents.

2. The electromagnetic device for producing cold neutral atoms according to claim 1, wherein the additional poles are formed of a substantially cylindrical core, one end of which is provided with a coaxial annular cavity whose interior accommodates an interior excitation coil.

3. The electromagnetic device for producing cold neutral atoms according to claim 1, wherein at least some of the poles have a sleeve with a tubular channel for circulation of a heat-regulating fluid.

4. The electromagnetic device for producing cold neutral atoms according to claim 3, wherein at least some of the poles are surrounded by a remanent-field compensating coil.

5. The electromagnetic device for producing cold neutral atoms according to claim 1, wherein the yokes are comprised of two annular elements with radius $R_{int}$ and $R_{ext}$ with $R_{ext}=R_{int}+E$ where E is the thickness of the yoke, the two elements being nestable and positioned in two perpendicular planes.

6. The electromagnetic device for producing cold neutral atoms according to claim 1, wherein the yoke is comprised of a first annular element extending over 180°, extended at each end by second annular elements extending over 90°, in a plane perpendicular to the plane of the first element, each of said second annular elements being coupled with an annular element extending over 180° in a plane perpendicular to the other annular elements.

7. The electromagnetic device for producing cold neutral atoms according to the claim 6, wherein the second annular elements extending over 90° are each surrounded by a coil exciting the main poles.

8. The electromagnetic device for producing cold neutral atoms according to claim 1, wherein the yokes and poles are made of a ferromagnetic material limiting Foucault currents.

9. The electromagnetic device for producing cold neutral atoms according to claim 1, wherein the ends of at least some of the poles are frustroconical.

10. The electromagnetic device for producing cold neutral atoms according to claim 1, wherein the poles also have secondary coils for remanent field compensation.

* * * * *